US012595520B2

(12) United States Patent
Meijer et al.

(10) Patent No.: US 12,595,520 B2
(45) Date of Patent: Apr. 7, 2026

(54) APPARATUS FOR THE PRODUCTION OF MOLTEN IRON

(71) Applicant: TATA STEEL IJMUIDEN B.V., JZ Velsen-Noord (NL)

(72) Inventors: Hendrikus Koenraad Albertus Meijer, Bergen (NL); Petrus Gerardus Jacobus Broersen, Lisse (NL)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 736 days.

(21) Appl. No.: 17/780,461

(22) PCT Filed: Nov. 27, 2020

(86) PCT No.: PCT/EP2020/083697
§ 371 (c)(1),
(2) Date: May 26, 2022

(87) PCT Pub. No.: WO2021/105400
PCT Pub. Date: Jun. 3, 2021

(65) Prior Publication Data

US 2022/0411888 A1 Dec. 29, 2022

(30) Foreign Application Priority Data

Nov. 28, 2019 (EP) ..... 19212178

(51) Int. Cl.
*C21B 13/00* (2006.01)

(52) U.S. Cl.
CPC ..... *C21B 13/0026* (2013.01)

(58) Field of Classification Search
CPC ..... C21B 13/0026; C21B 11/08; C21B 7/007; Y02P 10/134; C21C 5/567; C21C 2250/02; C21C 2250/04
USPC ..... 75/453
See application file for complete search history.

(56) References Cited

U.S. PATENT DOCUMENTS 4,087,274 A * 5/1978 Edenwall ..... C21B 13/002 75/10.36
6,440,195 B1 * 8/2002 Dry ..... F27B 3/225 75/502

FOREIGN PATENT DOCUMENTS

CN 86102198 A 12/1987
CN 104093861 A 10/2014
EP 0690136 A1 * 1/1996 ..... C21B 13/0006
EP 0690136 B1 3/2001
EP 0726326 B1 11/2001
(Continued)

OTHER PUBLICATIONS

Dona Gussow, "Natural Gas Specs Sheet" (Year: 2004).*
(Continued)

*Primary Examiner* — Danielle M. Carda
(74) *Attorney, Agent, or Firm* — Vorys, Sater, Seymour and Pease LLP; Maryellen Feehery Hank; Anthony P. Venturino

(57) ABSTRACT

Apparatus for the production of molten iron including a metallurgical vessel, having a surrounding wall, a cyclone part provided on top of a smelt reduction part, the cyclone part being in open connection with the smelt reduction part and having at least one supply apparatus around the circumference of the surrounding wall adjusted to introduce oxygen gas into the cyclone part, wherein the at least one supply apparatus is further adjusted to introduce a mixture of oxygen gas and a combustible gas.

10 Claims, 2 Drawing Sheets

(56) References Cited

FOREIGN PATENT DOCUMENTS

| | | | | | |
|---|---|---|---|---|---|
| EP | 2794931 | B1 | | 10/2014 | |
| EP | 3220083 | A1 | * | 9/2017 | ..... C21B 13/0026 |
| WO | 2013091847 | A1 | | 6/2013 | |
| WO | 2019185866 | A1 | | 10/2019 | |

OTHER PUBLICATIONS

Office Action for Chinese Patent Application No. 202080090454.6 issued Jun. 1, 2023.
Written Opinion and International Search of corresponding PCT Application No. PCT/EP2020/083697 mailed Feb. 26, 2021.

* cited by examiner

APPARATUS FOR THE PRODUCTION OF MOLTEN IRON

The invention relates to an apparatus for the production of molten iron comprising a metallurgical vessel, having a surrounding wall, a cyclone part provided on top of a smelt reduction part, the cyclone part being in open connection with the smelt reduction part and having at least one supply means around the circumference of the surrounding wall adjusted to introduce oxygen gas into the cyclone part. The invention also relates to a method of producing molten iron in a metallurgical vessel.

Apparatuses for the production of molten iron are known in the art. EP 0726 326 A1 describes such an apparatus, which is also known as the Hlsarna process by Tata Steel. Supply means around the circumference of the surrounding wall adjusted to introduce oxygen gas are known as well. For example EP 2794 931 B1 describes supply means adjusted for the introduction of oxygen gas into the cyclone part of the metallurgical vessel.

Unfortunately, this type of metallurgical vessel, having a cyclone part and a smelt reduction part, has the disadvantage that both parts cannot be controlled in an independent manner. Especially the temperature control inside the metallurgical vessel is difficult, as both parts are in open connection with each other. This means that an adjustment in the smelt reduction part influences the cyclone part and vice versa.

The temperature control in the smelt reduction part is usually controlled by inserting a carbon containing material in the slag layer. However, the insertion does not generate enough heat for the conversion from carbon, via carbon monoxide to carbon dioxide. The injection of oxygen gas in this part does generate enough energy, and therefore heat, as it converts the carbon monoxide to carbon dioxide. In order to keep the temperature within the processing window in the cyclone part, carbon containing material could be added in the smelt reduction part in the desired content. However, this still can lead to a lower than desired temperature in the cyclone part and the current way to solve this is by the addition of even more oxygen gas in the smelt reduction vessel. This in turn will then lead to a temperature that may be too high in the smelt reduction part. The balance in temperature between the cyclone part and the smelt reduction part is therefore a delicate one and both parts are not controlled well enough.

The inventors, being involved in finding more environmentally friendly solutions for molten iron production, found that this process could be controlled in a better way.

The object of this invention is to provide an apparatus and method that has a better control over the process. It is a further object to make better use of waste materials and to produce less waste material during the ironmaking process, with an emphasis on lowering the emission of $CO_2$ per tonne of molten iron.

Accordingly, an apparatus and method for the production of molten iron is provided wherein the at least one supply means is further adjusted to introduce a mixture of oxygen gas and a combustible gas. This has the advantage that the temperature control of the process in the cyclone part is more independent from the temperature control of the smelt reduction part, since introducing the combustible gas together with the oxygen gas releases a lot of energy during the combustion process. The supply means is not particularly limited and may be a lance or an injector. By controlling the amount of combustible gas that is introduced, the energy, and therefore the heat that is released in the process can also be controlled.

Tests and simulations have proven that introducing the combustible gas and the oxygen gas with a predetermined mixture in the cyclone part of the metallurgical vessel can be done without any further adjustments. When the combustible gas is introduced, it will introduce more heat just below the cyclone part, leading to a higher temperature, especially in the cyclone part, but, at least partly, in the smelt reduction part as well. In this way it will lead to a better control over the cyclone part of the metallurgical vessel since the flow of both gases can be controlled and therefore a predetermined mixture can be introduced. Furthermore, the control of flow, and therefore temperature will be more independent from the smelt reduction part.

The combustible gas can be introduced in the cyclone part or at the top of the smelt reduction part, or a combination thereof. If the combustible gas is introduced at the top of the smelt reduction part, this will lead to a partial combustion of the gas and therefore a lower required quantity of coal.

Preferably the combustible gas is selected from the group of coke oven gas, converter gas, natural gas, hydrogen gas and liquefied petroleum gas. Coke oven gas contains +/−3% carbon dioxide, +/−6% carbon monoxide, 60-65% hydrogen, +/−3% nitrogen and 25-30% methane. Converter gas roughly consists of 17-20% carbon dioxide, 60-65% carbon monoxide, +/−1.5% hydrogen and 15-20% nitrogen. The main requirement is that the nitrogen content of the combustible gas should be relatively low, less than 20% (v/v). In this way any combustible gas having a low nitrogen content could be introduced. The control of the temperature will be at its best when the combustible gas is fully combusted during the process.

The inventors have found particularly good results with natural gas. Natural gas is predominantly methane ($CH_4$) and the amount thereof depends on the source. An advantage of the use of coke oven gas and converter gas is that they are at times considered to be waste material leading to undesired emissions. Therefore the use of these gases is a preferable option to combat climate change and reduce the amount of carbon dioxide in the atmosphere. The inventors feel the responsibility to act and do something, however small the steps may be, about climate change. They have the desire to make the earth a more sustainable place for future generations and make climate activists happy, if at all possible.

If natural gas is used in a mixture containing 25% natural gas and 75% oxygen gas then an up to 2% reduction in $CO_2$ emissions was calculated by means of a simulation programme called IRMA (IRon MAking) model. The IRMA programme uses a flow sheet design to break down the total process in building blocks. These building blocks are connected through material stream blocks. In this way a complex process can be divided in a number of simple steps. Calculations are based on a mix of thermodynamic equilibrium relations and empirical relations. Thermodynamic calculations are carried out by the ChemApp library, which also furnishes the library for the thermodynamic data. ChemApp is a product of GTTTechnologies and is based on the SimuSage package. The empirical theory is based on the "Cyclone-converter heat and mass balance model" developed at Tata Steel (Corus). Most of the building blocks are validated using other model results or literature.

A further advantage of using natural gas is that methane will be converted under the processing conditions into carbon dioxide and water. As is commonly known, methane is also a greenhouse gas and has an even bigger greenhouse effect than carbon dioxide. In general, the addition of a combustible gas, like natural gas, leads to a reduced use of coal. And therefore also less carbon dioxide will be formed during the process, bringing the environmental benefits that the inventors are after.

Preferably, the supply means are symmetrically distributed over the circumference of the surrounding wall of the cyclone part or at the top of the smelt reduction unit. This is beneficial for a good gas distribution within the cyclone part of the metallurgical vessel and thereby also the temperature distribution. The top of the smelt reduction unit is located at or near the roof of the smelt reduction unit, just below the cyclone part.

Preferably, the supply means are adjusted to mix the oxygen gas and the combustible gas before entering the cyclone part. This is beneficial since this premixing increases the control of the mixture that is introduced into the cyclone part of the metallurgical vessel.

Preferably, a group of oxygen gas outlets is surrounding one or more combustible gas outlets. Preferably, a group of combustible gas outlets is surrounding one or more oxygen gas outlets. These embodiments both have the advantage that the mixture will be premixed just before being introduced into the cyclone part, even further improving control. A further advantage is that the mixture will be evenly distributed into the cyclone part.

The invention will hereinafter be further elucidated with reference to the drawing of an exemplary embodiment of an apparatus operating according to the invention that is not limiting as to the appended claims.

In the drawing.

Whenever in the figures the same reference numerals are applied, these numerals refer to the same parts.

Figure 1:
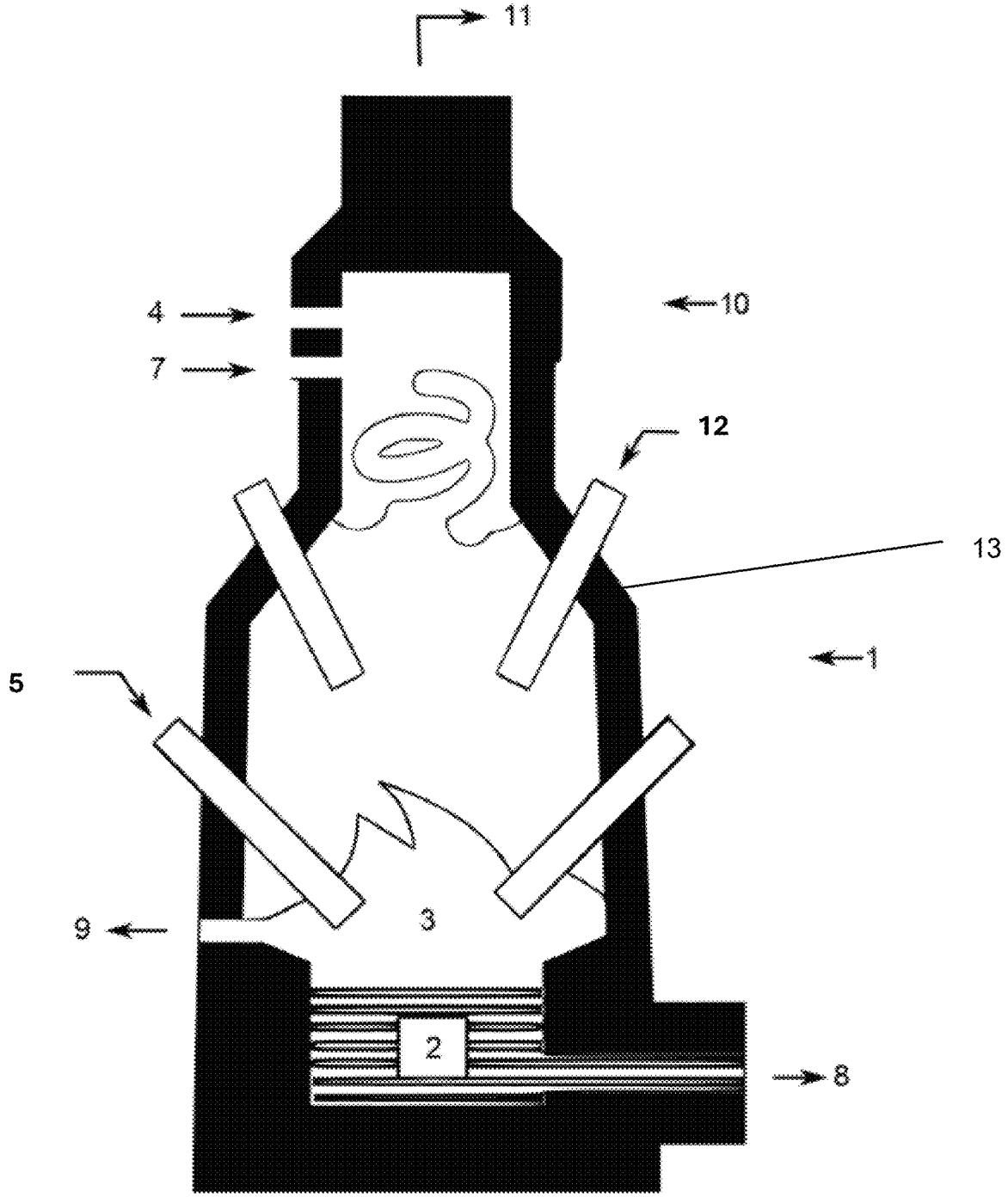
FIG. 1 shows an overview of the metallurgical vessel.

FIG. 1 shows an overview of the metallurgical vessel according to the process disclosed in patent application EP-A-0 726 326, wherein a metallurgical vessel 1 is applied with on top of the metallurgical vessel 1 a cyclone part 10. FIG. 1 clearly shows the introduction point 7 where oxygen gas or a mixture of oxygen gas and a combustible gas is injected in the smelt cyclone 10 at the top of the metallurgical vessel 1. Further FIG. 1 shows the bath of molten iron 2, a layer of slag 3, the introduction points for carbon containing material 5 and metalliferous feed 4, iron outlet 8, slag outlet 9 and the reaction gases outlet 11. For this invention only the introduction point of the oxygen gas 7 or a mixture of oxygen gas and a combustible gas 7 are of importance.

Figure 2:
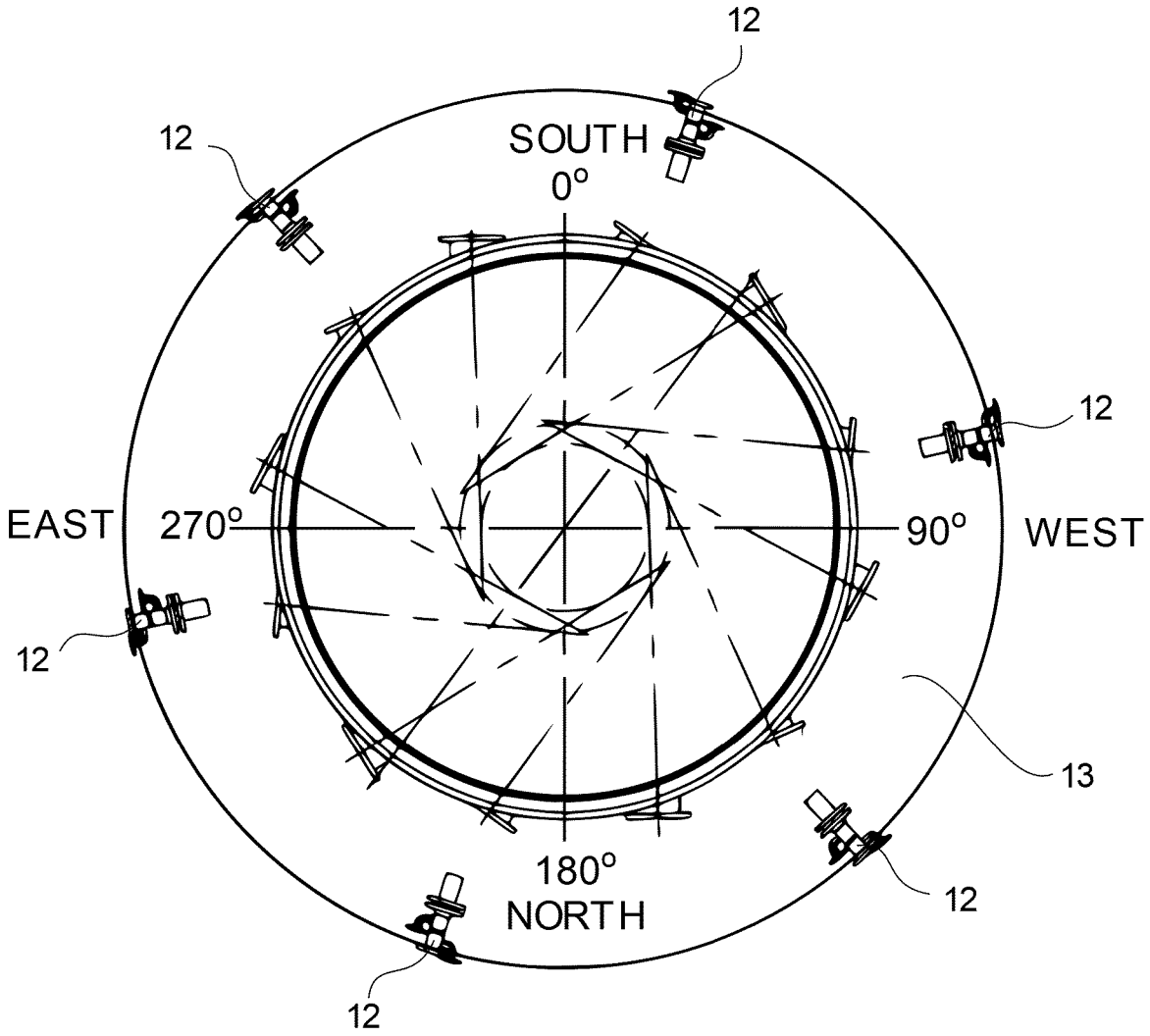
FIG. 2 shows a top view of the configuration of the supply means in the wall of the cyclone part.

FIG. 2 shows, in a top view, an example of the position of the supply means 12 in the surrounding wall 13 of the cyclone part 10. In this example six supply means 12 are symmetrically distributed around the circumference of the surrounding wall 13 of the cyclone part 10. This has found to give good results with respect to the control of the temperature in the cyclone part 10. Naturally, other configurations may be possible.

Although the invention has been discussed in the foregoing with reference to exemplary embodiments of the invention, the invention is not restricted to these particular embodiments which can be varied in many ways without departing from the invention. The discussed exemplary embodiments shall therefore not be used to construe the appended claims strictly in accordance therewith. On the contrary, the embodiments are merely intended to explain the wording of the appended claims, without intent to limit the claims to these exemplary embodiments. The scope of protection of the invention shall therefore be construed in accordance with the appended claims only, wherein a possible ambiguity in the wording of the claims shall be resolved using these exemplary embodiments.

The invention claimed is:

1. An apparatus for the production of molten iron comprising:

a metallurgical vessel having a surrounding wall, a cyclone part and a smelt reduction part, wherein the cyclone part is provided above the smelt reduction part, wherein the surrounding wall is angled and is below and adjacent to the cyclone part and above and adjacent to the smelt reduction part, the cyclone part being in open connection via the surrounding wall with the smelt reduction part and having at least one introduction point around the circumference of the cyclone part adjusted to introduce oxygen gas into the cyclone part, at least one supply means conduit in the surrounding wall, wherein the at least one supply means conduit in the surrounding wall is adjusted to introduce a mixture of oxygen gas and a combustible gas.

2. The apparatus for the production of molten iron according to claim 1, wherein the combustible gas is selected from the group of coke oven gas, converter gas, natural gas, hydrogen gas, and liquefied petroleum gas.

3. The apparatus for the production of molten iron according to claim 2, wherein the combustible gas contains less than 20% nitrogen gas.

4. The apparatus for the production of molten iron according to claim 1, wherein the at least one supply means conduit in the surrounding wall is located in the circumference of the surrounding wall above the top of the smelt reduction part.

5. The apparatus for the production of molten iron according to claim 1, wherein the at least one supply means conduit in the surrounding wall is symmetrically distributed in the circumference of the surrounding wall below the cyclone part.

6. The apparatus for the production of molten iron according to claim 1, wherein the at least one supply means conduit in the surrounding wall is symmetrically distributed in the circumference of the surrounding wall above the top of the smelt reduction part.

7. The apparatus for the production of molten iron according to claim 1, wherein the at least one supply means conduit in the surrounding wall is adjusted to mix the oxygen gas and the combustible gas before entering the metallurgical vessel.

8. The apparatus for the production of molten iron according to claim 1, wherein the at least one supply means conduit in the surrounding wall is configured such that a group of one or more oxygen gas outlets is surrounded by one or more combustible gas outlets.

9. The apparatus for the production of molten iron according to claim 1, wherein the at least one supply means conduit in the surrounding wall is configured such that a group of one or more combustible gas outlets is surrounded by one or more oxygen gas outlets.

10. The apparatus for the production of molten iron according to claim 1, wherein a first temperature control of the cyclone part is independent of a second temperature control of the smelt reduction part, and wherein the first temperature control comprises adjustment to the mixture introduced to the at least one supply means conduit in the surrounding wall.

* * * * *